US006866144B2

(12) United States Patent
Auclair

(10) Patent No.: US 6,866,144 B2
(45) Date of Patent: Mar. 15, 2005

(54) CARTON AND CARTON BLANK

(75) Inventor: Jean-Michel Auclair, Chateauroux (FR)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 10/364,200

(22) Filed: Feb. 11, 2003

(65) Prior Publication Data

US 2003/0205488 A1 Nov. 6, 2003

Related U.S. Application Data

(63) Continuation of application No. PCT/US01/24554, filed on Aug. 5, 2001.

(30) Foreign Application Priority Data

Aug. 11, 2000 (GB) ..... 0019775

(51) Int. Cl.[7] ..... B65D 75/00

(52) U.S. Cl. ..... 206/147; 206/153; 206/155; 206/427

(58) Field of Search ..... 206/427, 434, 206/140, 147, 151–153, 155, 158, 775, 781, 784, 486, 418, 419; 229/162.1

(56) References Cited

U.S. PATENT DOCUMENTS

| | | | | |
|---|---|---|---|---|
| 2,101,282 A | | 12/1937 | Piper | |
| 3,168,963 A | | 2/1965 | Wolowicz | |
| 3,276,574 A | | 10/1966 | Meyers | |
| 3,692,228 A | * | 9/1972 | Spiegel | 206/486 |
| 3,820,707 A | | 6/1974 | Fischer et al. | |
| 3,921,895 A | * | 11/1975 | Ziche | 206/486 |
| 4,131,198 A | | 12/1978 | Fischer | |
| 5,005,701 A | * | 4/1991 | Dutcher | 229/162.1 |

FOREIGN PATENT DOCUMENTS

| | | |
|---|---|---|
| EP | 0 122 397 A2 | 10/1984 |
| FR | 1 526 314 A | 10/1968 |
| GB | 825384 | 12/1959 |

* cited by examiner

*Primary Examiner*—Mickey Yu
*Assistant Examiner*—J. Gregory Pickett
(74) *Attorney, Agent, or Firm*—Tsugihiko Suzuki

(57) ABSTRACT

A carton and blank for forming a carton for holding one or more articles, for example, flexible pouches, which carton comprises an article-retaining structure for preventing the dislodgment of the packaged articles through the open ends of the carton. The article-retaining structure comprises a retention panel which extends between the carton side walls intermediate the top and base walls of the carton to form a tubular structure in cooperation with the top wall. The retention panel is formed with at least one article receiving aperture, wherein tubular structure is provided with a brace for retaining the tubular structure in an erected form.

15 Claims, 9 Drawing Sheets

CARTON AND CARTON BLANK

This is a continuation of international application No. PCT/US01/24554, filed Aug. 5, 2001, which is hereby incorporated by reference.

BACKGROUND OF THE INVENTION

This invention relates to a carton and a blank for forming a carton which is used for accommodating one or more articles, for example, flexible pouch packs or bottles. It also concerns the method of forming the carton from the blank and loading the same with one or more articles. More particularly, the invention relates to a wraparound carton incorporating a top-gripping structure which attaches to an upper portion of one or more articles thereby to secure the articles in an array.

Top-gripping cartons are well known, particularly in the field of multiple packaging of bottles. One example is illustrated in U.S. Pat. No. 3,168,963 which illustrates a wraparound carton having an article-retaining structure and a retention panel between the top and bottom walls formed with at least one article receiving aperture.

A problem associated with known top-gripping carriers is that the retention panel and/or tubular structure for retaining the article will tend to collapse which creates an unstable carrier.

SUMMARY OF THE INVENTION

The present invention seeks to overcome or at least mitigate the problems of the prior art.

One aspect of the invention provides a carton for holding one or more articles, for example, flexible pouches. The carton comprises a sleeve body and an article-retaining structure for preventing the dislodgment of the packaged articles through the open ends of the sleeve body. The sleeve body comprises top and base walls interconnected by a pair of side walls. The article-retaining structure comprises a retention panel extending between the side walls intermediate the top and base walls to form a tubular structure in cooperation with the top wall. The retention panel is formed with at least one article-receiving aperture. The tubular structure is provided with a brace for retaining the tubular structure in an erected form.

According to an optional feature of this aspect of the invention the brace may comprises a brace panel hingedly connected to the retention panel and folded into the tubular structure to engage the inner side surface of the tubular structure. Optionally, the brace panel is struck from the retention panel and defines the article-receiving aperture when folded into the tubular structure.

According to another optional feature of this aspect of the invention the brace panel may be provided with a friction tab hingedly connected to the brace panel, the friction tab being adapted to engage the upper portion of one of the carton side walls. Alternatively, the brace panel may be provided with a friction tab hingedly connected to the brace panel, the friction tab being adapted to be pressed against the inner side surface of the tubular structure to retain the tab in the folded position.

Preferably, friction tab is struck from the side wall of the tubular structure.

According to a further optional feature of this aspect of the invention the side wall may comprises an upper side panel hingedly interconnecting the top wall and the retention panel and the lower side wall panel connecting the base wall and attached to the upper side wall panel and wherein said friction tab is struck from the upper side wall panel.

Preferably, the lower side panel is attached to the outer surface of the upper side panel to cover the opening defined in the upper side panel by the friction tab. More preferably, a portion of the friction tabs is revealed in the opening defined in the upper side panel and wherein the friction tab is secured by glue to the lower side panel.

According to another optional feature of this aspect of the invention wherein at least one opening is formed in either the top wall or in the side wall of the article-retaining structure to allow the top portion of one of the articles to be exposed to view.

There may further comprise an end closure structure for closing the ends of the carton, which end closure structure comprising an enclosure panel and at least one glue flap hingedly connected to the end closure panel to be secured to one of the base or side wall panels of the carton.

A second aspect of the invention provides a blank for forming a carton for holding one or more articles, for example, flexible pouches, which blank comprises a plurality of panels for forming a carton including a first side wall panel, a base panel, a second side wall panel and a top panel hingedly connected one to the next, and an article-retaining structure extending from the top panel comprising a retention panel and securing means to connect the retention panel to the side walls panels to form a tubular structure in a set up carton, the retention panel is formed with at least one article receiving aperture and a brace for retaining the tubular structure in an erected form.

The brace may comprise a brace panel hingedly connected to the retention panel and adapted to be folded into the tubular structure to engage the inner side surface of the tubular structure.

According to an optional feature of the second aspect of the invention the brace panel is struck from the retention panel and defines the article-receiving aperture when folded into the tubular structure.

According to a further optional feature of the second aspect of the invention, the brace panel is provided with a friction tab hingedly connected to the brace panel. Optionally, the tab is struck from the side wall panel.

According to another optional feature of the second aspect of the invention the side wall panel may comprise an upper side panel hingedly interconnecting the top wall panel and a lower side wall panel connected to the base wall and wherein said friction tab is struck from the upper side wall panel.

There may further comprise at least one opening is formed in either the top wall panel or in the side wall panel of the article-retaining structure to allow the top portion of one of the articles to be exposed to view in the set up carton.

According to a still further optional feature of the second aspect of the invention there further comprises an end closure structure for closing the ends of the carton, which end closure structure comprising an enclosure panel and at least one glue flap hingedly connected to the end closure.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENTS

Figure 1:
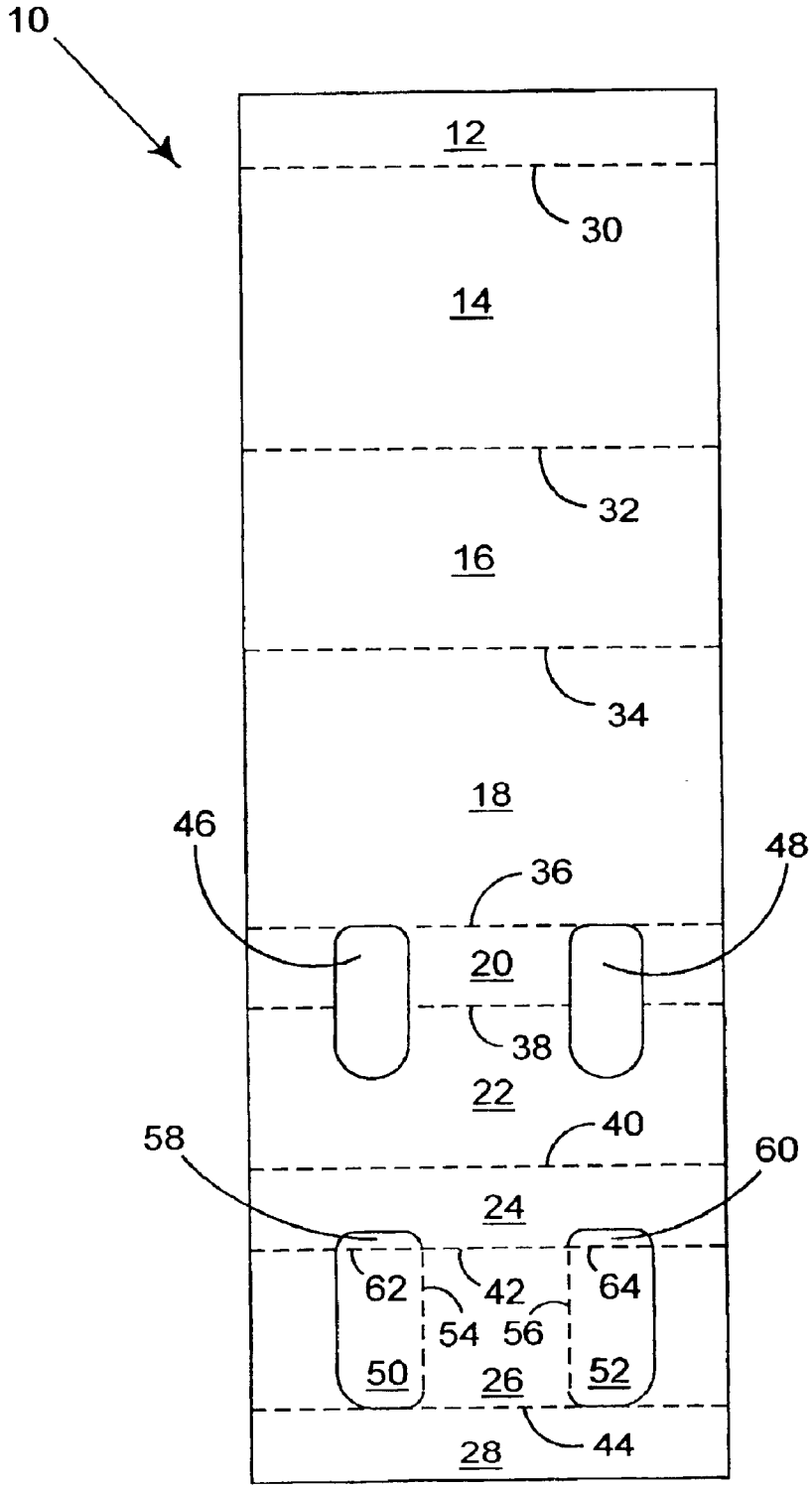
FIG. 1 is a plan view of a blank of a first embodiment of the invention.

Referring to the drawings, and in particular FIG. 1, there is shown a unitary blank 10 for forming an article carrier made from paperboard or similar foldable sheet material. In other embodiments, there may comprise a two-part blank, for example a blank for forming the wraparound carrier and a separate blank for forming the internal article-retaining structure. The blank 10 comprises a series of panels hingedly connected one to the next in series to define a top wall, opposed side walls and a base. Preferably, there comprises upper and lower side wall panels. Thus, the blank 10 comprises a plurality of panels for forming a wraparound carton, which in this embodiment comprises a first side wall panel 14, a base panel 16, second side wall panel 18, an upper second side wall panel 20 and top wall panel 22 hingedly connected together in series along fold line 32, 34, 36 and 38 respectively.

In order to secure the first side wall panel 14 to the top panel 22, suitable securing means is provided. In this embodiment, the securing means is provided by a securing flap 12 that is hingedly connected to the lateral edge of side panel 14 along fold line 30.

There further comprises a plurality of panels for forming the article-retaining structure which are hingedly connected to the top panel 22 along fold line 40. In this embodiment, the article-retaining structure is provided by a first spacer panel 24, a retention panel 26 and a securing panel 28 hingedly connected together in series along fold lines 42 and 44 respectively. The spacer panel 24 spaces the retention panel 26 from the top panel 22.

There may further comprise one or more display windows which are provided by apertures 46, 48 struck from upper second side wall panel 20 that extend into top panel 22, shown in FIG. 1. In use, the display apertures 46, 48 reveal a portion of the cap of the article retained within the carrier.

Figure 7:
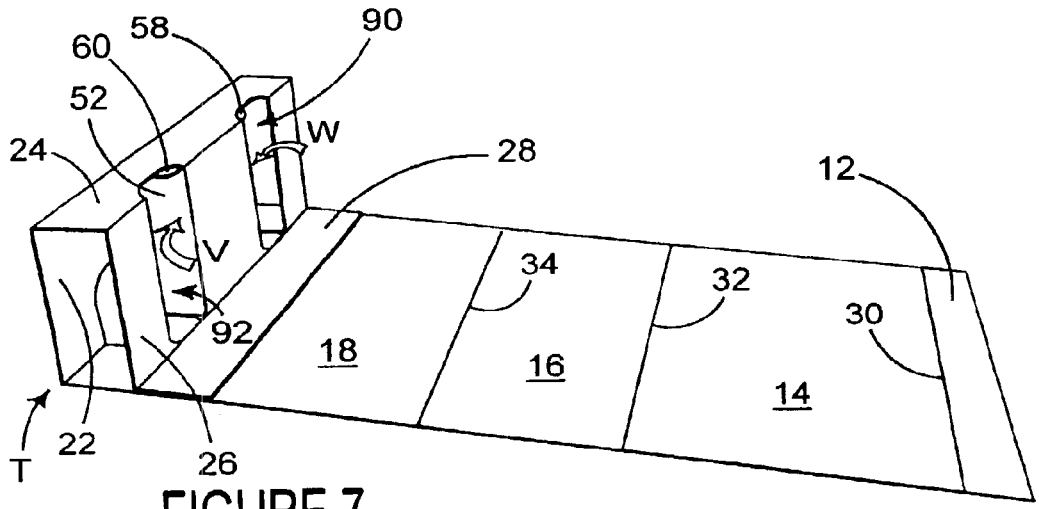

A brace is provided to prevent the article-retaining structure from collapsing. In FIG. 1, there comprises a brace panel 50 struck from and hingedly connected to retention panel 26 along fold line 54. Preferably, there further comprises a friction tab 58 struck from the adjacent spacer panel 24 and hingedly connected to bracing panel 50 along fold line 62. In use, the bracing panel 50 is folded out of alignment with retention panel 26 to reveal an article receiving aperture 90 (FIG. 7). A second bracing panel may be provided which, in this embodiment, is designated by a reference numeral 52 and is struck from retention panel 26 and hingedly connected thereto along fold line 56. Similarly, a friction tab 60 is hingedly connected to bracing panel 52 along fold line 64.

Figure 2:
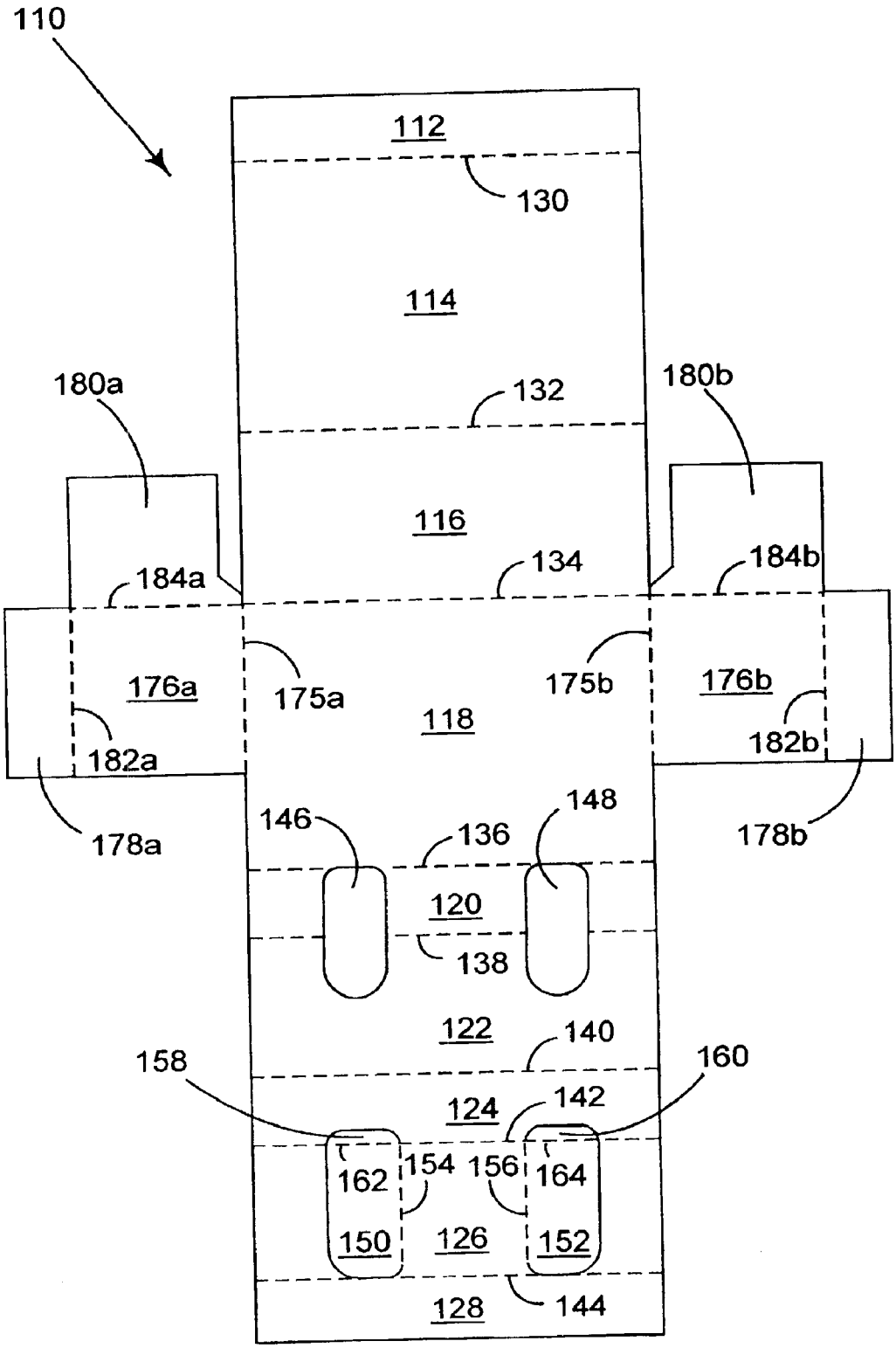
FIG. 2 is a plan view of a blank of a second embodiment of the invention.

Turning to the second embodiment illustrated in FIG. 2, the blank 110 is substantially the same as the first embodiment and like features are designated by the same reference numerals with the prefix "1". Therefore, only the differences shall be described in any further detail.

An end closure structure is provided to prevent the articles from inadvertently being removed, for example, before the product has been sold. The end closure structures are provided by opposing end panels 176*a* and 176*b* hingedly connected to opposing sides of side wall panel 118 along fold lines 175*a* and 175*b* respectively. Suitable securing means is provided to secure the end closure panels 176 in place, for example a locking tab and aperture arrangement could be used.

The construction of each end closure structure is the same, so like reference numerals have been used in FIG. 2 with the addition of letter's 'a' and 'b' respectively. In this embodiment, glue flaps 178 and 180 are provided to be secured to the adjacent first side wall panel 114 and the base wall 116 respectively. It will be seen from FIG. 2 that glue flap 178 is secured to a longitudinal edge of end closure panel 176 along fold line 182 and that glue flap 180 is secured to a lateral edge of end closure panel 176 along fold line 184, which in this embodiment is an extension of fold line 134.

Figure 3:
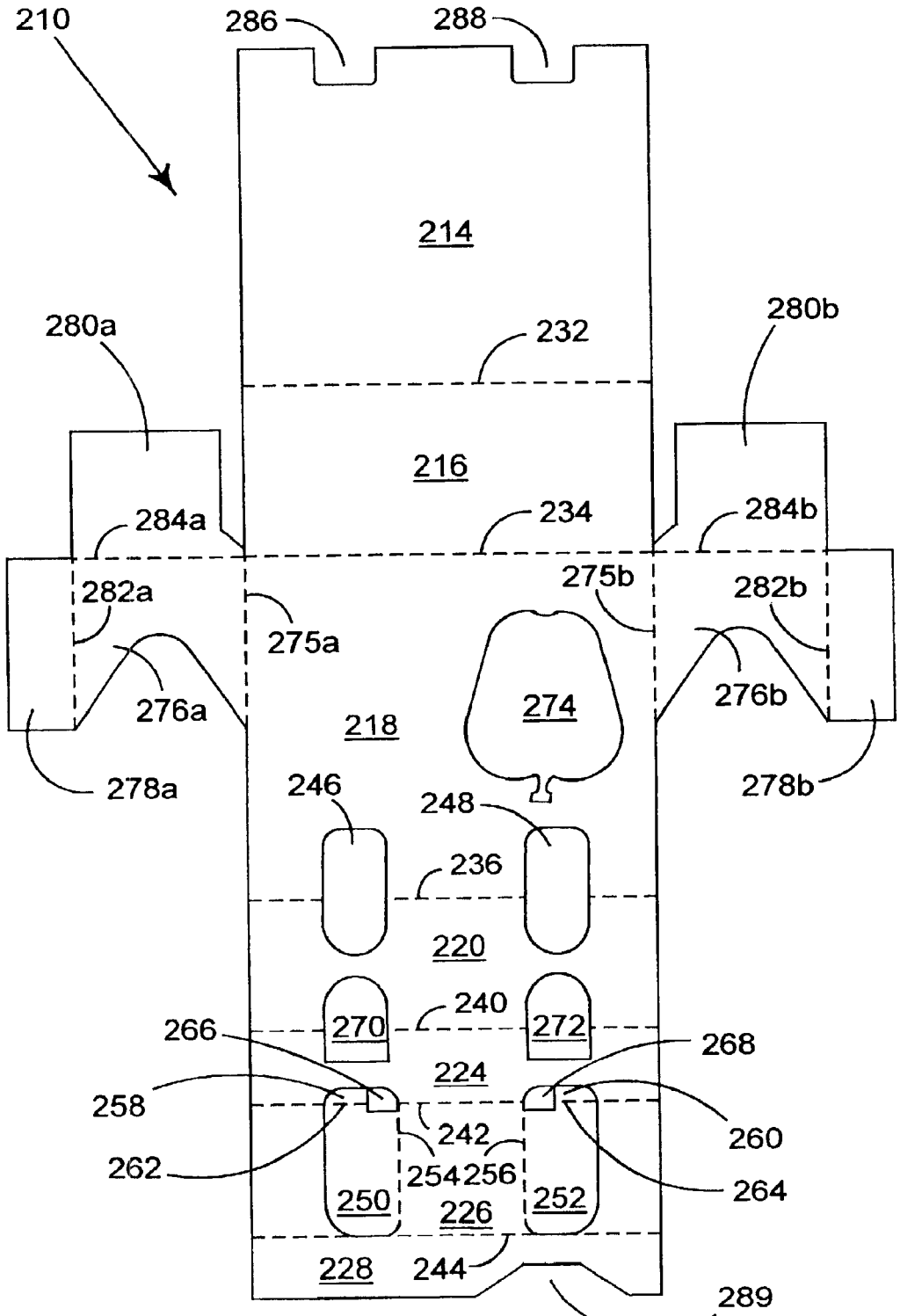
FIG. 3 is a plan view of a blank of a third embodiment of the invention.

Turning to the third embodiment illustrated in FIG. 3, it is similar to the first embodiment in its overall construction; and it is similar to the second embodiment in that there are provided end closure panels 276. Like features of the first and second embodiments are designated by the same reference numeral with the prefix "2".

Therefore, only those differences between the second and third embodiments are described in any further detail.

In the third embodiment, there further comprises an additional aperture 270 along the opposing part of top panel 220 which is aligned with the corresponding aperture 246. Aperture 270 is struck from top panel 220 and extends into spacer panel 224. In use, aperture 270 provides a second display window for the upper portion of the adjacent article A. Likewise, in those embodiments with two rows of articles, a second aperture 272 struck from top panel 220 and extending spacer panel 224 is provided to be substantially aligned with aperture 248.

There are also corresponding recesses 286, 288 along the free edge of side panel 214. In use, the recesses 286 and 288 are aligned with aperture 270 and 272 respectively to provide a display window.

In one class of embodiments, the friction tab 258 is not co-extensive with bracing panel 250 and terminates short, so that an aperture or notch 266 is provided. In use, the notch 266 functions to allow the tab 258 to protrude through the opening 270 to be engaged with an article. There is a similar notch 268 provided adjacent to bracing tab 260 that functions in the same way.

There may further comprise an aperture 274 struck from one of the side panels and a corresponding recess portion 289 in glue flap 228 to provide an additional display window to reveal part of the side wall of an article A.

Figure 14:
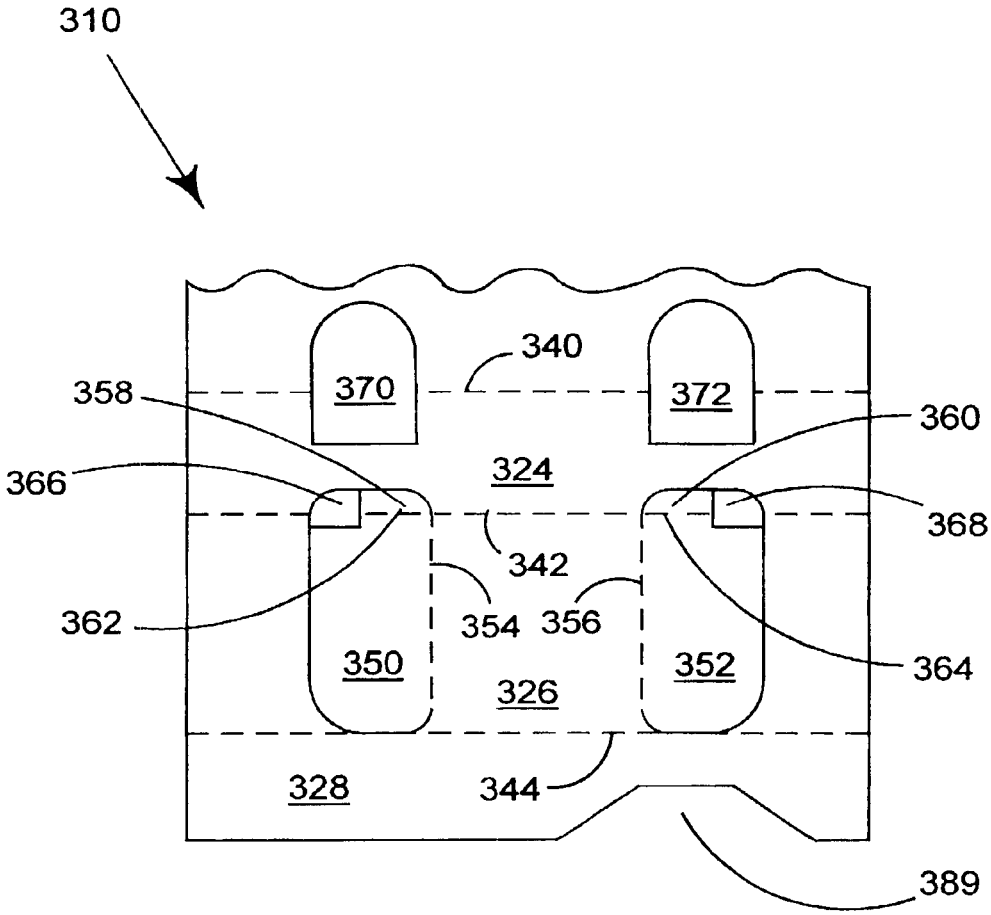
FIG. 14 is a fragmentary plan view of a blank of a fourth embodiment of the invention.

Turning to the fourth embodiment illustrated in FIG. 14, it is virtually identical to the third embodiment in its overall construction except for the details of the friction tabs. Like features of the third embodiment are designated by the same reference numeral with the prefix "3". Therefore, only those differences between the third and fourth embodiments are described in any further detail.

In the fourth embodiment, the friction tab 358, again, is not co-extensive with bracing panel 350 and terminates short. However, an aperture or notch 366 is defined adjacent to the free end edge of the bracing panel 350 remote from fold line 354. In use, the notch 366 functions to prevent the tab 358 from being exposed to view through opening 370. In other words, the notch 366 is struck from the friction tab 358 to cooperate with the opening 370 to provide a window to reveal the top portion of one of the articles. There is a similar notch 368 provided adjacent to the free end edge of bracing panel 352. The notch 368 functions to prevent friction tab 360 from being exposed to view through opening 372.

Turning to the construction of the carton formed from one of the blanks illustrated in FIGS. 1, 2, 3 or 14, it is envisaged that the carton of the present invention can be formed by a series of sequential folding and gluing operations which can be performed in a straight line machine, so that the carton is not required to be rotated or converted to complete its construction. The folding process is not limited to that described below and can be altered according to particular manufacturing requirements.

Figure 4:
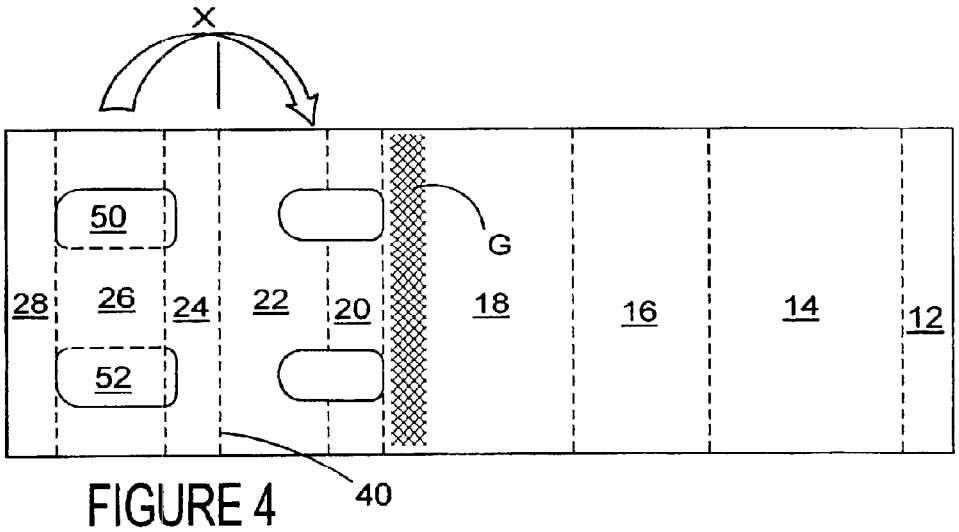
FIGS. 4 and 5 illustrate the first stages of construction of the first embodiment so that the carrier is in a flat collapsed condition ready to be supplied to an end user.
Figure 5:
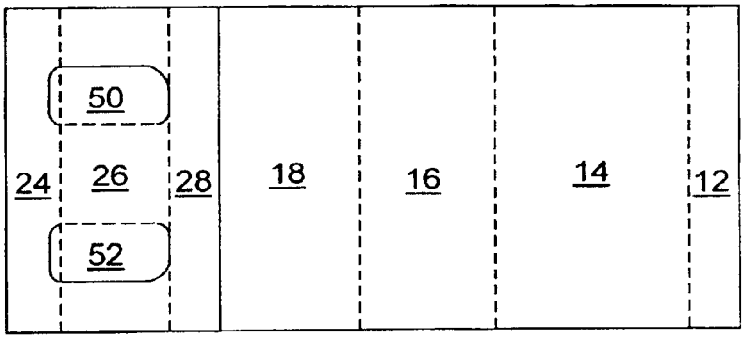

Turning now in particular to FIG. 4, the blank 10 of the first embodiment is folded in direction X along fold line 40 to form the internal article-retaining structure. Thus, spacer panel 24 and retention panel 26 are placed in face-contacting relationship with top panel 22 and upper second side wall panel 20 and are held in place by securing flap 28 to side wall panel 18 by glue G or other suitable securing means known in the art. The carrier is at an intermediate stage construction, shown in FIG. 5, whereby it is in flat collapsed condition ready to be supplied to a user, for example a bottler, to be loaded with articles, described below.

Figure 6:
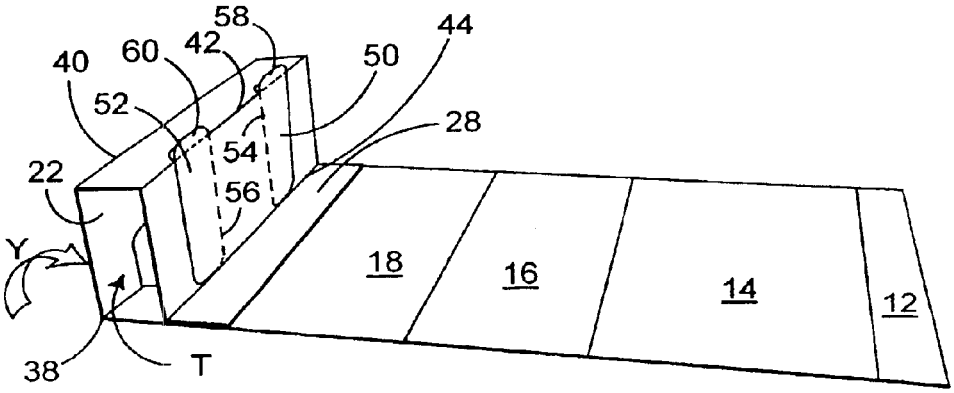
FIGS. 6, 7 and 8 illustrate the construction of the carrier from a flat collapsed condition illustrated in FIG. 5.

In order to construct and load the carrier, the retaining structure and brace are formed, whereby panels 20, 22, 24 and 26 forming the article-retaining structure are folded along fold lines 38, 40, 42 and 44 in direction Y so as to form a tubular structure T as shown in FIG. 6. This folding action reveals friction tabs 58 and 60 that are ready to form the brace. Thereafter, the brace is formed by folding brace panels 50 and 52 in directions W and V respectively along fold lines 54 and 56 as shown in FIG. 7 to take up a bracing position. The bracing panels 50, 52 act as braces by their free edges coming into contact with opposed spacer panels 24, 28 or, as the case may be, side walls. Additionally, or alternatively, the bracing tabs may abut the top wall to provide a brace between the top and retention panels 22, 26.

In those embodiments with friction tabs 58 and 60 are folded along fold lines 62 and 64, so as to come into face contacting relationship with spacer panel 24. It is envisaged that in some embodiments the spacer panels are dispensed with, in which case the friction tabs come into face contacting relationship with the side walls.

Turning again to the embodiment shown in FIG. 7, the brace panels 50, 52 are held in place by the frictional engagement between the inner face of spacer panel 24 and the tabs 58 and 60 respectively, thereby to maintain the tubular structure in a set-up condition. Optionally, glue may be applied to friction tabs 58, 60 so that they are secured to spacer panel 24. The tabs 58, 60 may be shaped so as to protrude in part 59, 61 (FIG. 9), through apertures 90, 92. Beneficially, this allows tabs 58, 60 to be secured directly to an outer panel of the carrier, for example, securing tab 12 to provide a structure of improved rigidity.

Figure 8:
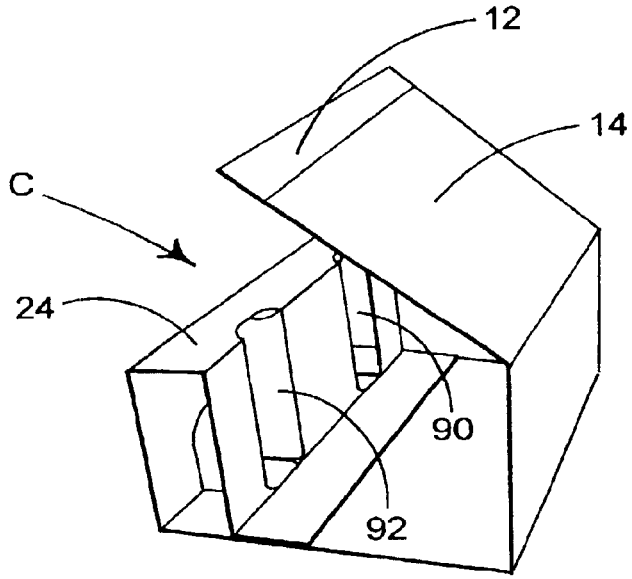

In order to complete construction of the carton, the panels forming the wraparound carrier are formed, so that the base panel 16 and first side wall panel 14 are folded out of alignment with second side wall panel 18 along fold lines 34 and 32 respectively as shown in FIG. 8.

Prior to constructing the wraparound carrier, the articles are applied to the carrier by relative movement between the article A and the tubular structure T, preferably during continuous forward movement. The articles are grouped in a two-by-two array although is anticipated that other groupings or even a single article could be packaged without departing from the scope of the invention.

Figure 9:
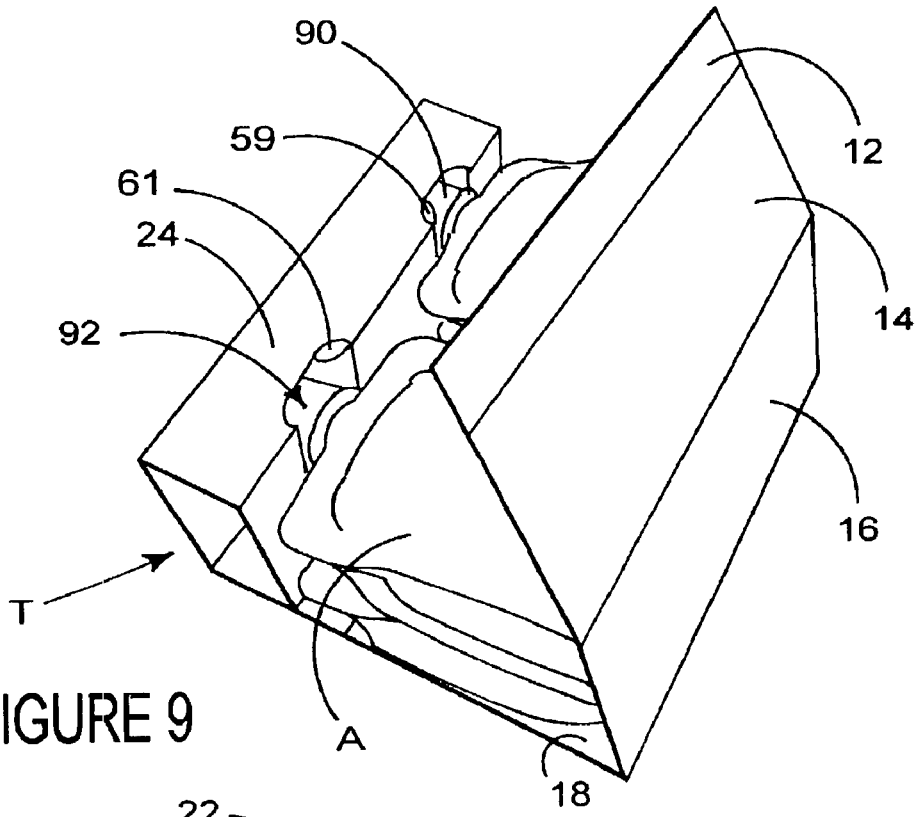
FIG. 9 illustrates the carrier shown in FIG. 5 in an erected and loaded condition.
Figure 10:
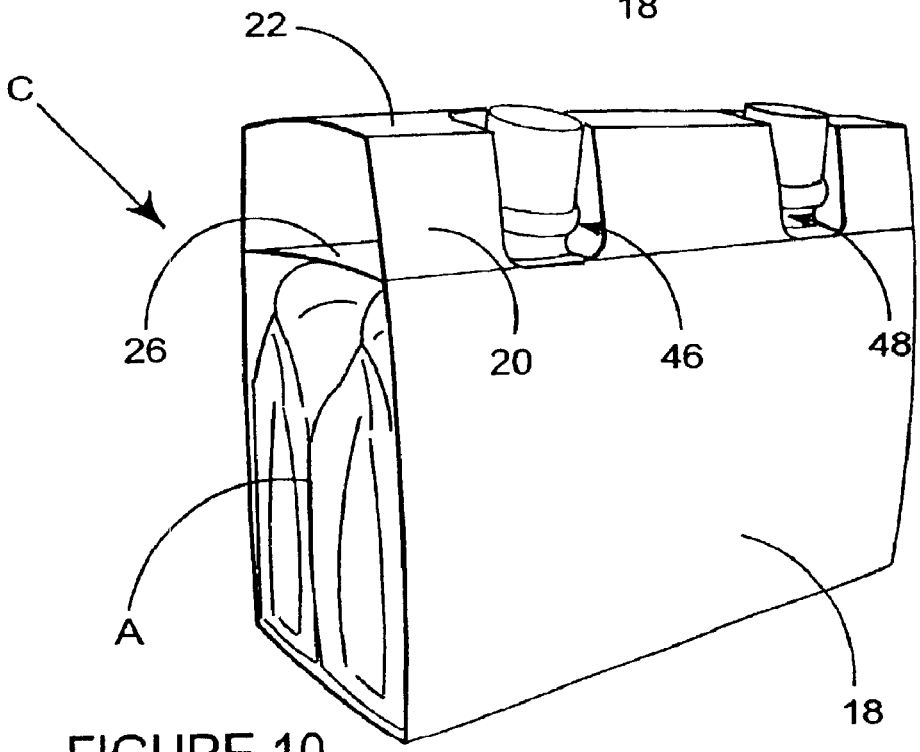
FIG. 10 illustrates the carrier shown in FIG. 5 in a set-up and completed condition.

As shown in FIGS. 9 and 10 the articles pass through apertures 90 and 92 to be held in place within the tubular structure T. In some embodiments, suitable retention means engage the upper part of the article(s) to prevent any movement within the apertures 90, 92. Thereafter, the side and base walls are folded as described above and the first side wall panel 14 is secured to the article-retaining structure by securing glue flap 12 to spacer panel 24 by glue or other suitable means known in the art. Thus, the carton is in set-up and loaded condition as shown in FIG. 10.

It will be seen that the articles to be packaged, in this embodiment, are flexible foil pouches and so, in order to retain the articles in place, the panels forming the wraparound carrier are drawn in tightly by moving the securing flap 12 up along spacer panel 24 prior to being secured therewith so as to provide a stable and easy stacking package.

Figure 11:
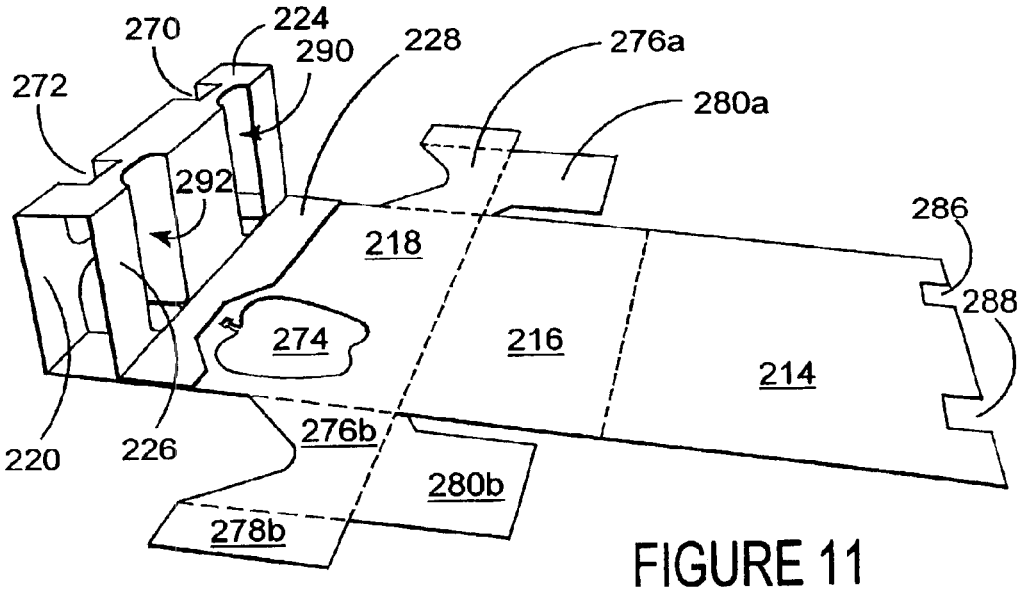
FIGS. 11 and 12 illustrate the construction of the carrier according to the third embodiment of the blank shown in FIG. 3.
Figure 12:
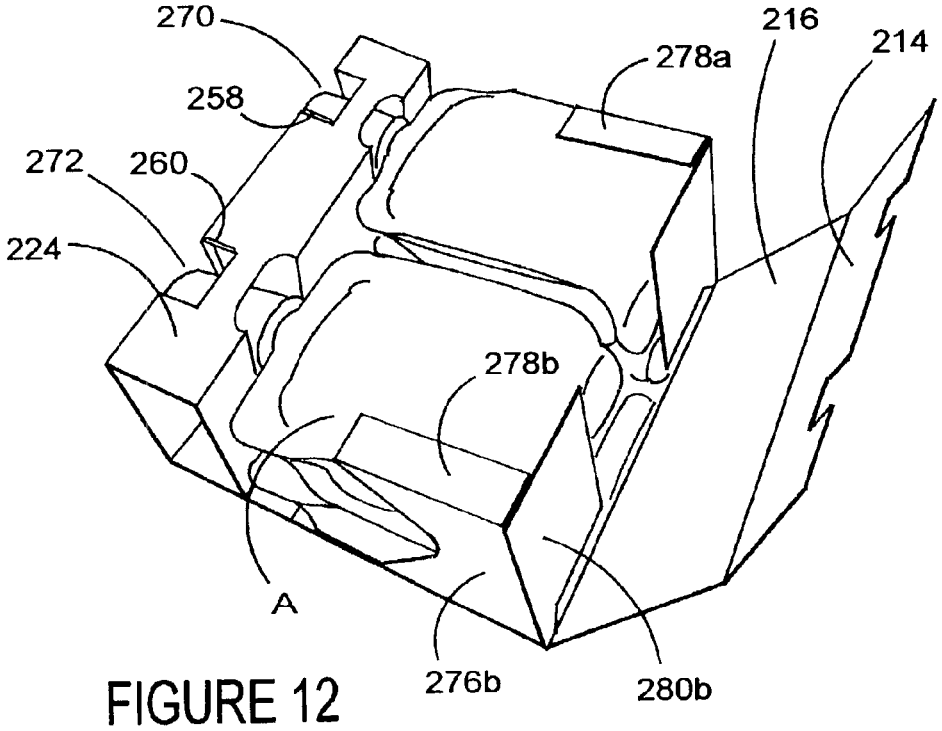
Figure 13:
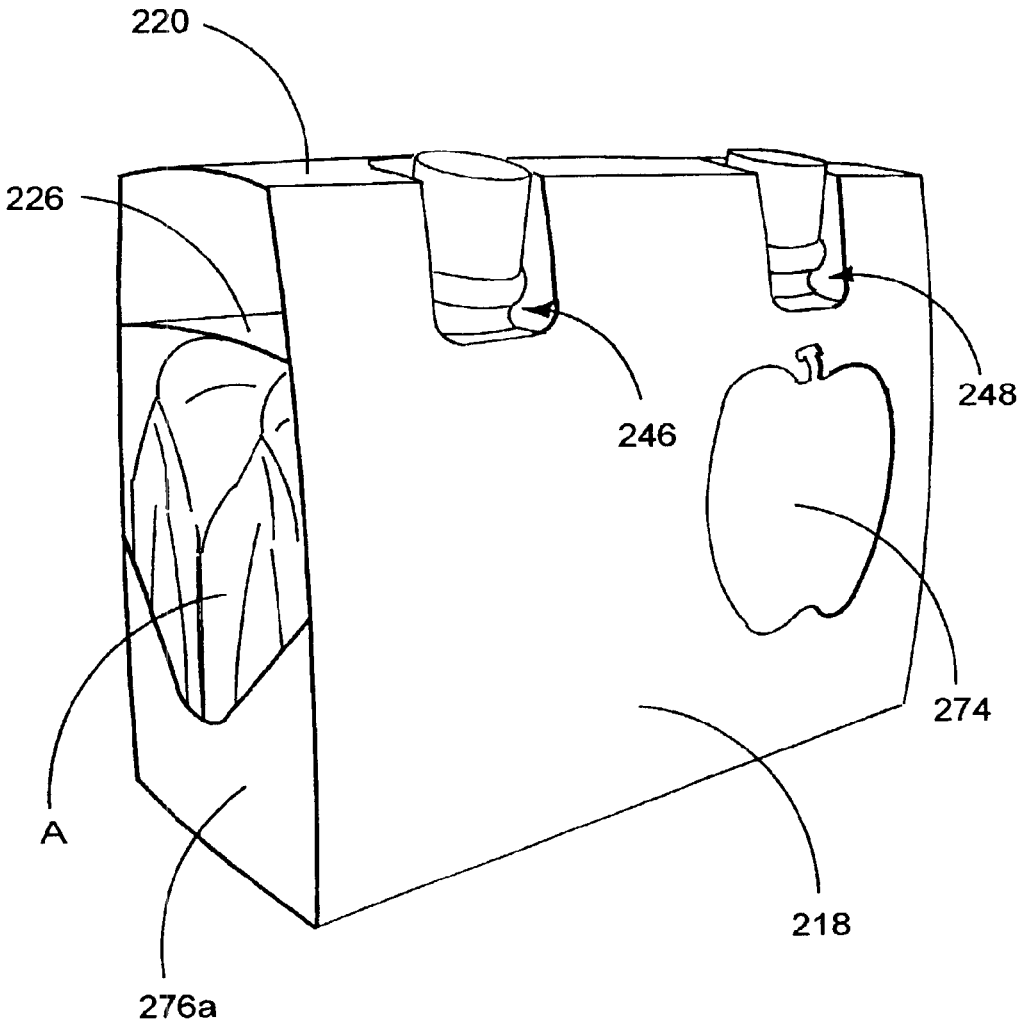
FIG. 13 is a perspective view of the erected carton formed from the blank of FIG. 3.

The construction of the second, third and fourth embodiments are substantially the same as the first embodiment described and illustrated in FIGS. 4, 5, 6 and 7 and, therefore, only the construction of the end closure structure is described in any greater detail. The articles A are applied to the article-retaining structure by relative vertical movement during continuous forward feed, as shown in FIGS. 11 and 12, and before folding the base and side wall panels 216, 214, the end closure structure is formed. This is achieved by folding end wall panel 276 inwardly along fold line 275. In addition, glue flaps 278 and 280 are folded along fold lines 282 and 284 respectively around the articles A, as illustrated in FIG. 12. Thereafter, the base and/or first side wall panel 214 may be secured to the glue flaps 278 and/or 280 respectively to retain the end closure panels 276 in place. Thus, the carton is in a set-up condition as shown in FIG. 13.

In the embodiment shown in FIG. 12, the friction tabs 258 and 260 are engaged in apertures 270 and 272 respectively, to retain the brace panels 250 and 252 in a bracing position.

The present invention and its preferred embodiments relate to an arrangement for forming a brace in an article-retaining structure formed from material that also forms one or more article receiving apertures. However, it is anticipated that the invention can be applied to a variety of carriers and not limited to those of a wraparound type described above.

It will be recognized that as used herein, directional references such as "top", "base", "end", "side", "inner", "outer", "upper" and "lower" do not limit the respective panels to such orientation, but merely serve to distinguish these panels from one another. Any reference to "hinged connection" or fold line should not be constructed as necessarily referring to a single fold line only; indeed, it is envisaged that "hinged connection" can be formed from one or more the following, score line, a frangible line or a fold line, without departing from the scope of the invention.

It should be understood that various changes can be made within the scope of the present invention. For example, the size and shape of the panels and apertures may be adjusted to accommodate articles of different size or shape, alternatively top and base closure structures may be used. The carton may accommodate more than one article in different arrays. In the illustrated embodiment, there comprise four articles arranged in two-by-two array although, of course, other arrays are envisaged.

What is claimed is:

1. A carton for holding one or more articles, comprising a sleeve body and an article-retaining structure for preventing dislodgment of packaged articles through open ends of the sleeve body, the sleeve body comprising top and base opposed walls and a pair of opposed side walls, the article-retaining structure comprising a retention panel extending between the side walls intermediate the top and base walls to form a tubular structure in cooperation with the top wall, the retention panel being formed with at least on article-receiving aperture, the tubular structure being provided with a brace for retaining the tubular structure in an erected form, said brace comprising a brace panel hingedly connected to the retention panel along a first fold line and a friction tab hingedly connected to the brace panel along a second fold line, the brace panel being folded into the tubular structure to engage the tubular structure, the friction tab being folded to be pressed against an inside surface of the tubular structure to retain the brace panel in the folded position, said second fold line being disposed transversely of said first fold line.

2. The carton as claimed in claim 1, wherein the brace panel is struck from the retention panel and defines the article-receiving aperture when folded into the tubular structure.

3. The carton as claimed in claim 1, wherein the friction tab is disposed in engagement with an upper portion of one of the side walls.

4. A carton for holding one or more articles, comprising a sleeve body and an article-retaining structure for preventing dislodgment of packaged articles through open ends of the sleeve body, the sleeve body comprising top and base opposed walls and a air of opposed side walls, the article-retaining structure comprising a retention panel extending between the side walls intermediate the top and base walls to form a tubular structure in cooperation with the top wall, the retention panel being formed with at least one article-receiving aperture, the tubular structure being or provided with a brace for retaining the tubular structure in an erected form, said brace comprising a brace panel hingedly connected to the retention panel and a friction tab hingedly connected to the brace panel, the brace panel being folded into the tubular structure to engage the tubular structure, the friction tab being folded to be pressed against an inside surface of the tubular structure to retain the brace panel in the folded position, wherein the friction tab is struck from a part of one of the side walls.

5. A carton for holding one or more articles, comprising a sleeve body and an article-retaining structure for preventing dislodgment of packaged articles through open ends of the sleeve body, the sleeve body comprising top and base opposed walls and a pair of opposed side walls, the article-retaining structure comprising a retention panel extending between the side walls intermediate the top and base walls to form a tubular structure in cooperation with the top wall, the retention panel being formed with at least one article-receiving aperture, the tubular structure being provided with a brace for retaining the tubular structure in an erected form, said brace comprising a brace panel hingedly connected to the retention panel and a friction tab hingedly connected to the brace panel, the brace panel being folded into the tubular structure to engage the tubular structure, the friction tab being folded to be pressed against an inside surface of the tubular structure to retain the brace panel in the folded position, wherein the brace panel is struck from the retention panel and defines the article-receiving aperture when folded into the tubular structure, wherein one of the side walls comprises an upper side wall panel hingedly interconnecting the top wall with the retention panel, and a lower side wall panel connected to the base wall and attached to the upper side wall panel, and wherein the friction tab is struck from the upper side wall panel.

6. The carton as claimed in claim 5, wherein the lower side wall panel is attached to an outside surface of the upper side wall panel to cover an opening defined in the upper side wall panel by the friction tab.

7. The carton as claimed in claim 6, wherein a portion of the friction tab is revealed in the opening in the upper side wall panel, and wherein the friction tab is secured by glue to the lower side wall panel.

8. The carton as claimed in claim 1, wherein at least one opening is formed in either the top wall or in one of the side walls to allow a part of the articles to be exposed to view.

9. A carton as claimed in claim 1, further comprising an end closure structure for closing at least one of the ends of the sleeve body, the end closure structure comprising an end enclosure panel and at least one glue flap hingedly connected to the end closure panel to be secured to at least one of the base wall and the side walls.

10. A blank for forming a carton for holding one or more articles, the blank comprising a plurality of panels for forming a carton including a first side wall panel, a base panel, a second side wall panel and a top panel hingedly connected one to next, and an article-retaining structure for connecting between the first and second side wall panels in a set up carton, the retaining structure comprising a retention panel and securing means or connecting the retention panel to one of the first and second side wall panels to form a tubular structure in a set up carton, the retention panel being formed with at least one article-receiving aperture and a brace for retaining the tubular structure in an erected form, the brace comprising a brace panel hingedly connected to the retention panel along a first fold line and a friction tab hingedly connected to the brace panel alone a second fold line, said second fold line being disposed transversely of said first fold line.

11. The blank as claimed in claim 10, wherein the brace panel is struck from the retention panel and defines the one article-receiving aperture when folded into the tubular structure.

12. A blank for forming a carton for holding one or more articles. the blank comprising a plurality of panels for forming a carton including first side wall panel, a base panel a second side wall panel and a top panel hingedly connected one to next, and an article-retaining structure for connecting between the first an second side wall panels in a set up carton, the retaining structure comprising a retention panel and securing means for connecting the retention panel to one of the first and second side wall panels to form a tubular structure in a set up carton, the retention panel being formed with at least one article-receiving aperture and a brace for retaining the tubular structure in an erected form, the brace comprising a brace panel hingedly connected to the retention panel and a friction tab hingedly connected to the brace panel, wherein the friction tab is struck from one of the first and second side wall panels.

13. A blank for forming a carton for holding one or more articles, the blank comprising a plurality of panels for forming a carton including first side wall panel, a base panel, a second side wall panel and a top panel hingedly connected one to next, and an article-retaining structure for connecting between the first and second side wall panels in a set up carton, the retaining structure comprising a retention panel and securing means for connecting the retention panel to one of the first and second side wall panels to form a tubular structure in a set up carton, the retention panel being formed with at least one article-receiving aperture and a brace for retaining the tubular structure in an erected form, the brace comprising a brace panel hingedly connected to the retention panel and a friction tab hingedly connected to the brace panel, wherein one of the side wall panels comprises an upper portion hingedly interconnecting the top panel with the retention panel, and a lower portion connected to the base panel, and wherein said friction tab is struck from the upper portion.

14. The blank as claimed in claim 10, wherein at least one opening is formed in either the top panel or in one of the side wall panels to allow a part of the articles to be exposed to view in the set up carton.

15. The blank as claimed in any of claim 10, further comprising an end closure structure for closing at least one of opposed ends of the carton, the end closure structure comprising an end enclosure panel and at least one glue flap hingedly connect to the end closure panel.

* * * * *